US007986102B2

(12) United States Patent
Roberts

(10) Patent No.: US 7,986,102 B2
(45) Date of Patent: Jul. 26, 2011

(54) ADJUSTABLE COLOR SOLID STATE LIGHTING

(75) Inventor: Bruce R. Roberts, Mentor-on-the-Lake, OH (US)

(73) Assignee: General Electric Company, Schenectady, NY (US)

( * ) Notice: Subject to any disclaimer, the term of this patent is extended or adjusted under 35 U.S.C. 154(b) by 390 days.

(21) Appl. No.: 12/209,490

(22) Filed: Sep. 12, 2008

(65) Prior Publication Data

US 2010/0066255 A1 Mar. 18, 2010

(51) Int. Cl.
*H05B 39/02* (2006.01)
*H05B 39/04* (2006.01)

(52) U.S. Cl. ..... 315/209 R; 315/291

(58) Field of Classification Search ..... 315/209 R, 315/210, 291, 307, 312, 224, 302
See application file for complete search history.

(56) References Cited

U.S. PATENT DOCUMENTS 5,924,784 A 7/1999 Chliwnyj et al.
6,016,038 A 1/2000 Mueller et al.
6,448,550 B1 9/2002 Nishimura
6,552,607 B1 4/2003 Danielson
6,753,661 B2 * 6/2004 Muthu et al. ..... 315/291
6,773,139 B2 8/2004 Sommers
6,975,369 B1 12/2005 Burkholder
7,140,752 B2 11/2006 Ashdown
7,323,824 B2 * 1/2008 Brates et al. ..... 315/224
7,656,103 B2 * 2/2010 Shteynberg et al. ..... 315/312
2007/0195024 A1 * 8/2007 Korcharz et al. ..... 345/82
2007/0242459 A1 * 10/2007 Nishigaki ..... 362/276
2007/0247414 A1 * 10/2007 Roberts ..... 345/102
2008/0116818 A1 * 5/2008 Shteynberg et al. ..... 315/192
2008/0136770 A1 * 6/2008 Peker et al. ..... 345/102

OTHER PUBLICATIONS

Artistic Licence (UK) Ltd., "Application Note 008. Frequency Modulation Techniques for the control of LED Colour Mixing and Intensity.", pp. 2, 2002.
Motorola Semiconductor Technical Data, "8-bit microcomputer with PWM outputs and LED drive," Motorola LTD., pp. 8, 1990.

* cited by examiner

*Primary Examiner* — Douglas W Owens
*Assistant Examiner* — Minh D A
(74) *Attorney, Agent, or Firm* — Fay Sharpe LLP

(57) ABSTRACT

A multi-channel light source has different channels for generating illumination of different channel colors corresponding to the different channels. An electrical power supply selectively energizes the channels using time division multiplexing to generate illumination of a selected time-averaged color.

19 Claims, 6 Drawing Sheets

ADJUSTABLE COLOR SOLID STATE LIGHTING

BACKGROUND

The following relates to the illumination arts, lighting arts, and related arts.

Solid state lighting devices include light emitting diodes (LEDs), organic light emitting diodes (OLEDs), semiconductor laser diodes, or so forth. While adjustable color solid state lighting devices are illustrated as examples herein, the adjustable color control techniques and apparatuses disclosed herein are readily applied to other types of multicolor light sources, such as incandescent light sources (for example, incandescent Christmas tree lights), incandescent, halogen, or other spotlight sources (for example, stage lights in which selectively applied spotlights illuminate a stage), or so forth.

In solid state lighting devices including a plurality of LEDs of different colors, control of both intensity and color is commonly achieved using pulse width modulation (PWM). For example, Chliwnyj et al., U.S. Pat. No. 5,924,784 discloses independent microprocessor-based PWM control of two or more different light emitting diode sources of different colors to generate light simulating a flame. Such PWM control is well known, and indeed commercial PWM controllers have long been available specifically for driving LEDs. See, e.g., Motorola Semiconductor Technical Data Sheet for MC68HC05D9 8-bit microcomputer with PWM outputs and LED drive (Motorola Ltd., 1990). In PWM, a train of pulses is applied at a fixed frequency, and the pulse width (that is, the time duration of the pulse) is modulated to control the time-integrated power applied to the light emitting diode. Accordingly, the time-integrated applied power is directly proportional to the pulse width, which can range between 0% duty cycle (no power applied) to 100% duty cycle (power applied during the entire period).

Existing PWM illumination control has certain disadvantages. They introduce a highly non-uniform load on the power supply. For example, if the illumination source includes red, blue, and green illumination channels and driving all three channels simultaneously consumes 100% power, then at any given time the power output may be 0%, 33%, 66%, or 100%, and the power output may cycle between two, three, or all four of these levels during each pulse width modulation period. Such power cycling is stressful for the power supply, and dictates using a power supply with switching speeds fast enough to accommodate the rapid power cycling. Additionally, the power supply must be large enough to supply the full 100% power, even though that amount of power is consumed only part of the time.

Power variations during PWM may be avoided by diverting current of each "off" channel through a "dummy load" resistor. However, the diverted current does not contribute to light output and hence introduces substantial power inefficiency.

Existing PWM control systems are also problematic as relating to feedback control. To provide feedback control of a color-adjustable illumination source employing existing PWM techniques, the power level of each of the red, green, and blue channels must be independently measured. This typically dictates the use of three different light sensors each having a narrow spectral receive window centered at the respective red, green, and blue wavelengths. If further division of the spectrum is desired, then the problem then becomes very expensive to solve. If for instance a five channel system has two colors that are very close to one another, only a very narrow band detector is able to detect variations between the two sources.

BRIEF SUMMARY

In some illustrative embodiments disclosed herein, an adjustable color light source comprises: a light source having different channels for generating illumination of different channel colors corresponding to the different channels; and an electrical power supply selectively energizing the channels using time division multiplexing to generate illumination of a selected time averaged color.

In some illustrative embodiments disclosed herein, an adjustable color light generation method comprises: generating a drive electrical current; energizing a selected channel of a multi-channel light source using the generated drive electrical current; cycling the energizing amongst channels of the multi-channel light source fast enough to substantially suppress visually perceptible flicker due to the cycling; and controlling a time division of the cycling to generate a selected time averaged color.

In some illustrative embodiments disclosed herein, an adjustable color light source comprises: a plurality of illumination channels for generating illumination of different channel colors; and an electrical power supply cycling an electrical drive current amongst the plurality of illumination channels to generate illumination of a selected time averaged color, the cycling being non-overlapping in that exactly one illumination channel is driven by the electrical drive current at any point in the cycling.

BRIEF DESCRIPTION OF THE DRAWINGS

The invention may take form in various components and arrangements of components, and in various process operations and arrangements of process operations. The drawings are only for purposes of illustrating preferred embodiments and are not to be construed as limiting the invention.

DETAILED DESCRIPTION OF PREFERRED EMBODIMENTS

Figure 1:
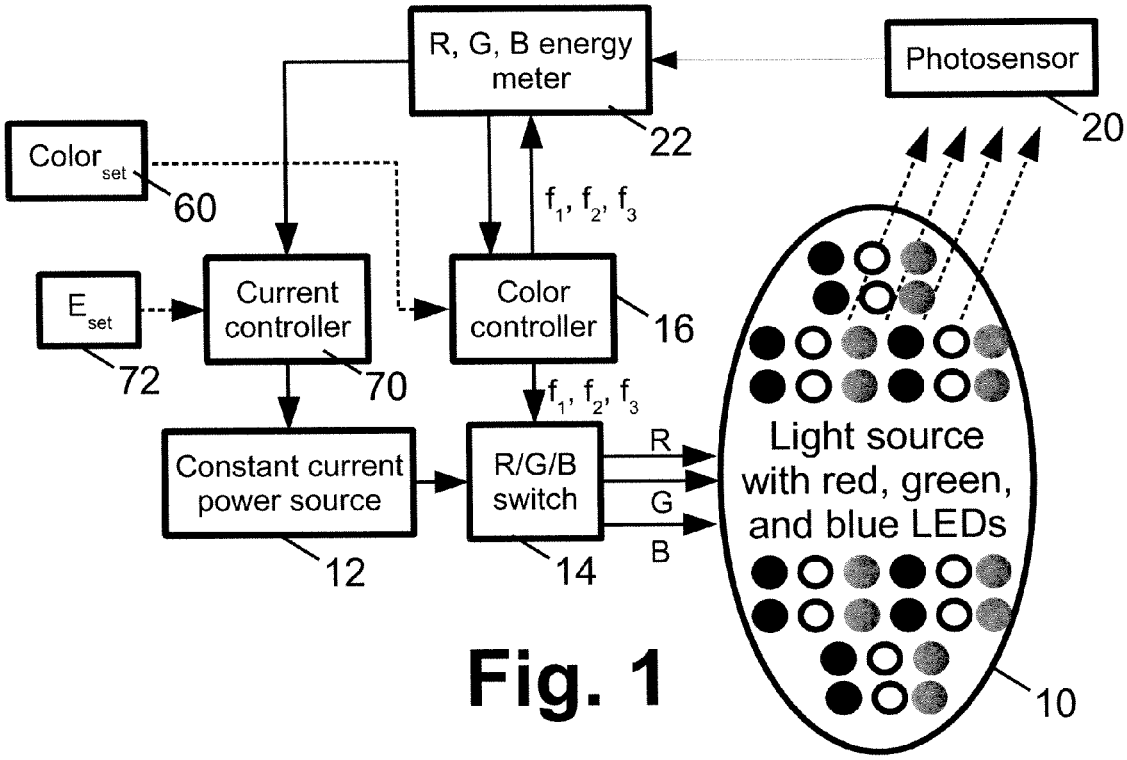
FIG. 1 diagrammatically illustrates an illumination system.

With reference to FIG. 1, a solid state lighting system includes a light source 10 having a plurality of red, green, and blue light emitting diodes (LEDs). The red LEDs are electrically interconnected (circuitry not shown) to be driven by a red input line R. The green LEDs are electrically interconnected (circuitry not shown) to be driven by a green input line G. The blue LEDs are electrically interconnected (circuitry not shown) to be driven by a blue input line B. The light source 10 is an illustrative example; in general the light source can be any multi-color light source having sets of solid state light sources electrically interconnected to define different color channels. In some embodiments, for example, the red, green, and blue LEDs are arranged as red, green, and blue LED strings. Moreover, the different colors can be other than red, green, and blue, and there can be more or fewer than three different color channels. For example, in some embodiments a blue channel and a yellow channel are provided, which enables generation of various different colors that span a color range less than that of a full-color RGB light source, but including a "whitish" color achievable by suitable blending of the blue and yellow channels. The individual LEDs are diagrammatically shown as black, gray, and white dots in the light source 10 of FIG. 1. The LEDs can be semiconductor-based LEDs (optionally including integral phosphor), organic LEDs (sometimes represented in the art by the acronym OLED), semiconductor laser diodes, or so forth.

The light source 10 is driven by a constant current power source 12. By "constant current" it is meant that the power source 12 outputs a constant rms (root-mean-square) current. In some embodiments the constant rms current is a constant d.c. current. However, the constant rms current can be a sinusoidal current with a constant rms value, or so forth. The "constant current" is optionally adjustable, but it is to be understood that the current output by the constant current power source 12 is not cycled rapidly as is the case for PWM. The output of the constant current power source 12 is input to a R/G/B switch 14 which acts as a demultiplexer or one-to-three switch to channel the constant current into one, and only one, of the three color channels R, G, B at any given time.

Figure 2:
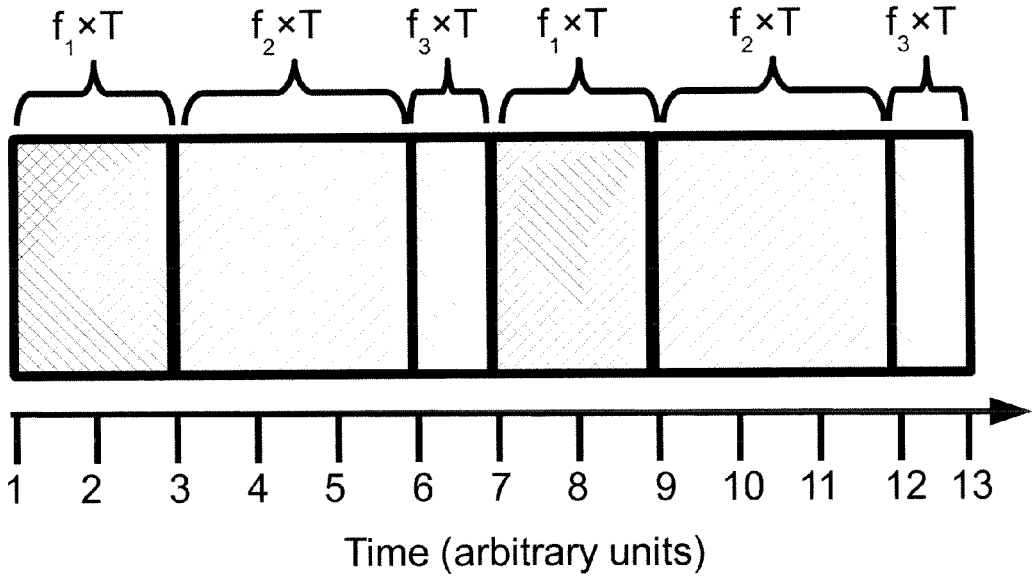
FIG. 2 diagrammatically illustrates a timing diagram for the R/G/B switch of the illumination system of FIG. 1.

The basic concept of the color control achieved using the constant current power source 12 and the R/G/B switch 14 is illustrated by a timing diagram shown in FIG. 2. The switching of the R/G/B switch 14 is performed over a time interval T, which is divided into three time sub-intervals defined by fractional periods $f_1 \times T$, $f_2 \times T$, and $f_3 \times T$ where $f_1+f_2+f_3=1$ and accordingly the three time periods obey the relationship $f_1 \times T+f_2 \times T+f_3 \times T=T$. A color controller 16 outputs a control signal indicating the fractional periods $f_1 \times T$, $f_2 \times T$, and $f_3 \times T$. For example, the color controller 16 may, in an illustrative embodiment, output a two-bit digital signal having value "00" indicating the fractional time period $f_1 \times T$, and switching to a value "01" to indicate the fractional time period $f_2 \times T$, and switching to a value "10" to indicate the fractional time period $f_3 \times T$, and switching back to "00" to indicate the next occurrence of the fractional time period $f_1 \times T$, and so on. In other embodiments, the control signal can be an analog control signal (e.g., 0 volts, 0.5 volts, and 1.0 volts indicating the first, second, and third fractional time periods, respectively) or can take another format. As yet another illustrative approach, the control signal can indicate transitions between fractional time periods, rather than holding a constant value indicative of each time period. In this latter approach, the R/G/B switch 14 is merely configured to switch from one channel to the next when it receives a control pulse, and the color controller 16 outputs a control pulse at each transition from one fractional time period to the next fractional time period.

During the first fractional time period $f_1 \times T$ the R/G/B switch 14 is set to flow the constant current from the constant current power source 12 into a first one of the color channels (for example, into the red channel R). As a result, the light source 10 generates only red light during the first fractional time period $f_1 \times T$. During the second fractional time period $f_2 \times T$ the R/G/B switch 14 is set to flow the constant current from the constant current power source 12 into a second one of the color channels (for example, into the green channel G). As a result, the light source 10 generates only green light during the second fractional time period $f_2 \times T$. During the third fractional time period $f_3 \times T$ the R/G/B switch 14 is set to flow the constant current from the constant current power source 12 into a third one of the color channels (for example, into the blue channel B). As a result, the light source 10 generates only blue light during the third fractional time period $f_3 \times T$. As indicated in FIG. 2, this cycle repeats with the time period T.

The time period T is selected to be shorter than the flicker fusion threshold, which is defined herein as the period below which the flickering caused by the light color switching becomes substantially visually imperceptible, such that the light is visually perceived as a substantially constant blended color. That is, T is selected to be short enough that the human eye blends the light output during the fractional time intervals $f_1 \times T$, $f_2 \times T$, and $f_3 \times T$ so that the human eye perceives a uniform blended color. Insofar as PWM also is based on the concept of visual blending of rapidly cycled light of different colors, the period T should be comparable to the pulse period used in PWM which is also below the flicker fusion threshold, for example below about 1/10 second, and preferably below about 1/24 second, and more preferably below about 1/30 second, or still shorter. A lower limit on the time period T is imposed by the switching speed of the R/G/B switch 14, which can be quite fast since its operation does not entail changing current levels (as is the case for PWM).

Quantitatively, the color can be computed as follows. The total energy of red light output by the red LEDs during the first fractional time interval $f_1 \times T$ is given by $a_1 \times f_1 \times T$; the total energy of green light output by the green LEDs during the second fractional time interval $f_2 \times T$ is given by $a_2 \times f_2 \times T$; and the total energy of blue light output by the blue LEDs during the third fractional time interval $f_3 \times T$ is given by $a_3 \times f_1 \times T$; where the constants $a_1$, $a_2$, $a_3$ are indicative of the relative efficiencies of the sets of red, green, and blue LEDs, respectively. For example, if for a given electrical current the light energy output by the set of red LEDs equals the light energy output by the set of green LEDs equals the light energy output by the set of blue LEDs, then a proportionality of $a_1:a_2:a_3$ is appropriate. On the other hand, if the set of blue LEDs outputs twice as much light for a given electrical current level as compared with the other sets of LEDs, then a proportionality of $2 \times a_1:2 \times a_2:a_3$ is appropriate. Optionally, the constants $a_1$, $a_2$, $a_3$ represent the relative visually perceived brightness levels, rather than the relative photometric energy levels. The color is determined by the proportionality of the red, green, and blue light energy outputs, i.e. by the proportionality of $a_1 \times f_1 \times T:a_2 \times f_2 \times T:a_3 \times f_3 \times T$ or more simply $a_1 \times f_1:a_2 \times f_2: a_3 \times f_3$. For example, in illustrative FIG. 2 $f_1:f_2:f_3$ is 2:3:1 which (taking $a_1=a_2=a_3$ for simplicity) means that the relative ratio of red:green:blue is 2:3:1. If the fractional periods had proportionality $f_1:f_2:f_3=1:1:1$ then (again taking $a_1=a_2=a_3$ for simplicity) the light output would be visually perceived as an equal blending of red, green, and blue light, which is to say the light output would be white light.

Advantageously, the current output by the constant current power source 12 into the light source 10 remains the same at all times. In other words, from the viewpoint of the constant current power source 12, it is outputting a constant current to the load comprising the components 10, 14.

In some embodiments the switching between fractional time periods performed by the color controller 16 is done in an open-loop fashion, that is, without reliance upon optical feedback. In these embodiments, a look-up table, stored mathematical curves, or other stored information associates values of proportionality of the fractional ratios $f_1:f_2:f_3$ with various colors. For example, if $a_1=a_2=a_3$ then the values $f_1=f_2=f_3=1/3$ is suitably associated with the "color" white.

Figure 3:
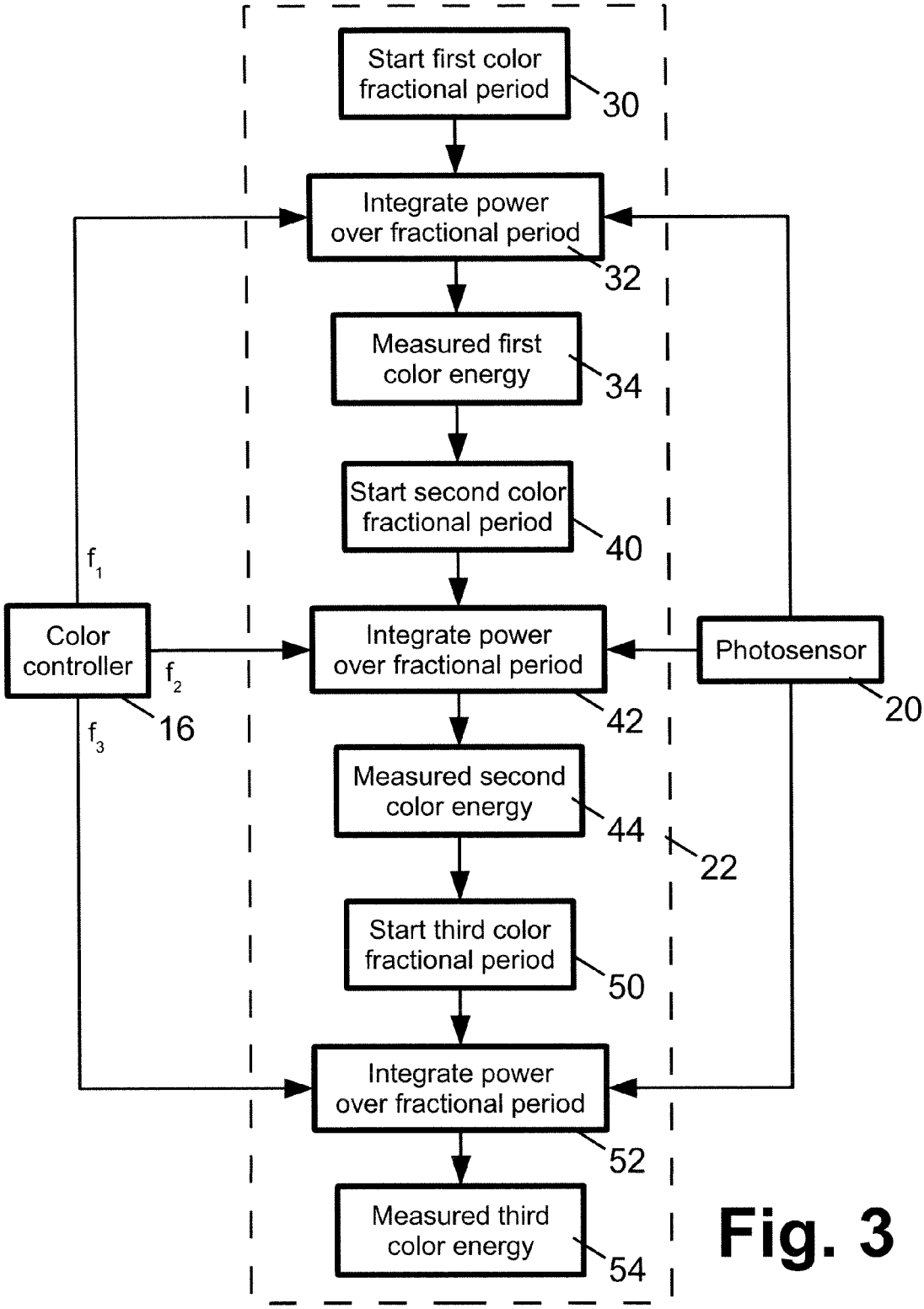
FIG. 3 diagrammatically illustrates the energy meter of the illumination system of FIG. 1.

With continuing reference to FIG. 1 and with further reference to FIGS. 3 and 4, in other embodiments the color is optionally controlled using optical feedback as follows. A photosensor 20 monitors the light power output by the light source 10. The photosensor 20 is of sufficiently broad wavelength to sense any of the red, green, or blue light. For simplicity, it is assumed herein that the photosensor 20 has equal sensitivity for red, green, and blue light—if this is not the case, it is straightforward to incorporate a suitable scaling factor to compensate for spectral sensitivity differences. FIG. 3 illustrates a suitable optical power measurement process performed by a R, G, B energy meter 22. At a start 30 of a first color fractional period (i.e., the start of the fractional period $f_1 \times T$), an optical power measurement is initiated. The measured optical power is integrated 32 over the first fractional period $f_1 \times T$ to generate a measured first color energy 34. Note that because only one set of LEDs of a single color (e.g., red) is operating during the first fractional period $f_1 \times T$, the broadband photosensor 20 measures only red light during the time interval of the integration 32. At a transition 40 to the second fractional time interval $f_2 \times T$, a second optical power integration 42 is initiated which extends over the second fractional time period $f_2 \times T$ in order to generate a measured second color energy 44. Again, because only one set of LEDs of a single color (e.g., green) is operating during the second fractional period $f_2 \times T$, the broadband photosensor 20 measures only green light during the time interval of the integration 42. At a transition 50 to the third fractional time interval $f_3 \times T$, a third optical power integration 52 is initiated which extends over the third fractional time period $f_3 \times T$ in order to generate a measured third color energy 54. Yet again, because only one set of LEDs of a single color (e.g., blue) is operating during the third fractional period $f_3 \times T$, the broadband photosensor 20 measures only blue light during the time interval of the integration 52.

Thus, it is seen that the single broadband photosensor 20 is capable of generating all three of the measured first color energy 34, the measured second color energy 44, and the measured third color energy 54. This is achieved because the control system 12, 14, 16 ensures that only a single set of LEDs of a single color are operational at any given time. In contrast, with existing PWM system two or more sets of LEDs of different colors may be operational at the same time, which then dictates that different narrowband photosensors centered on the different colors are used to simultaneously disambiguate and measure the light of the different colors.

Figure 4:
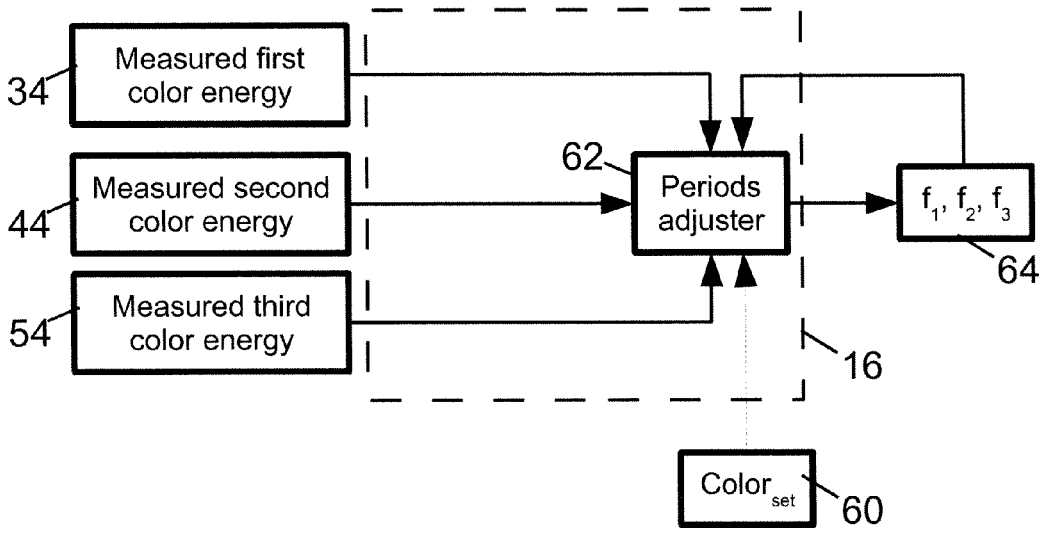
FIG. 4 diagrammatically illustrates the color controller of the illumination system of FIG. 1.

With reference to FIG. 4, the color controller 16 suitably uses the measured color energies 34, 44, 54 to implement feedback color control as follows. The first measured color energy 34 is denoted herein as $E_{M1}$. The second measured color energy 44 is denoted herein as $E_{M2}$. The third measured color energy 34 is denoted herein as $E_{M3}$. The measured color is then suitably represented by the ratio $E_{M1}:E_{M2}:E_{M3}$. The measured color was achieved using a set of fractional time intervals represented by the proportionality $f_1^{(n)}:f_2^{(n)}:f_3^{(n)}$, where the superscript (n) denotes the $n^{th}$ interval of time period T during which the integrations 32, 42, 52 generated the measured color energies 34, 44, 54.

A desired or setpoint color 60 is suitably represented by the ratio $E_{S1}:E_{S2}:E_{S3}$. A periods adjuster 62 computes adjusted of fractional time intervals 64 represented herein by the proportionality $f_1^{(n+1)}:f_2^{(n+1)}:f_3^{(n+1)}$, where the superscript (n+1) denotes the next interval of time period T which is to be divided into the subintervals $f_1^{(n+1)} \times T$, $f_2^{(n+1)} \times T$, and $f_3^{n+1)} \times T$, subject to the constraint $f_1^{n+1)}+f_2^{(n+1)}+f_3^{(n+1)}=1$. It is also known that $f_1^{(n)}+f_2^{(n)}+f_3^{(n)}=1$. The solution is suitably computed using ratios, for example:

$$\frac{E_{S1}}{E_{S2}} = \frac{\left(E_{M1} \times \frac{f_1^{(n+1)}}{f_1^{(n)}}\right)}{\left(E_{M2} \times \frac{f_2^{(n+1)}}{f_2^{(n)}}\right)}, \tag{1}$$

$$\frac{E_{S1}}{E_{S3}} = \frac{\left(E_{M1} \times \frac{f_1^{(n+1)}}{f_1^{(n)}}\right)}{\left(E_{M3} \times \frac{f_3^{(n+1)}}{f_3^{(n)}}\right)}, \tag{2}$$

and $$\frac{E_{S2}}{E_{S3}} = \frac{\left(E_{M2} \times \frac{f_2^{(n+1)}}{f_2^{(n)}}\right)}{\left(E_{M3} \times \frac{f_3^{(n+1)}}{f_3^{(n)}}\right)}, \tag{3}$$

which along with the relationship constraint $f_1^{(n+1)}+f_2^{(n+1)}+f_3^{(n+1)}=1$ provides a set of equations in which all parameters are known except the updated fractional time intervals $f_1^{(n+1)}$, $f_2^{(n+1)}$, and $f_3^{(n+1)}$ 64. The updated fractional time intervals $f_1^{(n+1)}$, $f_2^{(n+1)}$, and $f_3^{(n+1)}$ 64 are suitably computed by simultaneous solution of this set of Equations.

In other embodiments, iterative adjustments are used to iteratively adjust the measured optical energies ratio $E_{M1}:E_{M2}:E_{M3}$ toward the color setpoint 60 given by the desired energies ratio $E_{S1}:E_{S2}:E_{S3}$. For example, in one iterative approach whichever measured energy has the largest deviation from its setpoint energy is adjusted proportionately. For example, if the first measured energy 34 deviates most strongly, then the adjustment $f_1^{(n+1)}=(E_{S1}/E_{M1}) \times f_1^{(n)}$ is made. The remaining two fractional time intervals are then adjusted to ensure the condition $f_1^{(n+1)}+f_2^{(n+1)}+f_3^{(n+1)}=1$ is satisfied. This adjustment is repeated for each time interval T to iteratively adjust toward the setpoint color 60.

These are merely illustrative examples, and other algorithms can be used to adjust the fractions $f_1$, $f_2$, $f_3$ based on the feedback measured color energies 34, 44, 54 to achieve the setpoint color 60. Moreover, in some embodiments the integrators 32, 42, 52 are omitted and instead the instantaneous power is measured using the photosensor 20. The energy is then calculated by multiplying the instantaneous power times the fractional time interval $f_1 \times T$ (for the first fractional time interval), assuming that the measured instantaneous power is constant over the fractional time interval. Moreover, in some embodiments the measured color energy is represented not as a photometric value but rather as a visually perceived brightness level, by scaling the photometric values measured by the photosensor 20 by the optical response, which is known to be spectrally varying. As used herein, "color energy" is intended to encompass either photometric values or visually perceived brightness levels.

The constant current power source 12 generates a constant current on the timescale of the time interval T for cycling the R/G/B switch 14. However, it is contemplated to adjust the electrical current level to achieve overall intensity variation for the adjustable color light source 10. Such adjustment is suitably performed using a current controller 70 in an open-loop fashion, in which the electrical current level is set in an open-loop fashion using a manual current control dial input, an automatically controlled electrical signal input, or so forth.

Note that because the color control operates on a ratio basis (even when using optional optical feedback as described with reference to FIGS. 3 and 4), adjustment of the current level of the constant current source on a time scale substantially larger than the time interval T for the R/G/B cycling has little or no impact the color control.

Figure 5:
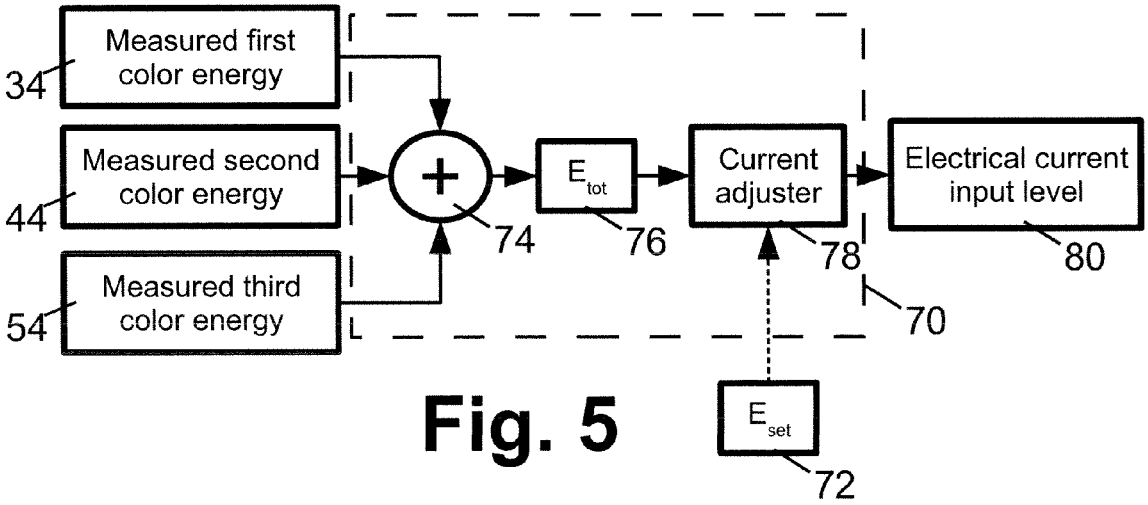
FIG. 5 diagrammatically illustrates the current controller of the illumination system of FIG. 1.

With continuing reference to FIG. 1 and with further reference to FIG. 5, in some embodiments, it is contemplated for the current controller 70 to operate in an optical feedback-controlled mode to achieve a light intensity output corresponding to a setpoint intensity $E_{set}$ 72. In the illustrated feedback-controlled intensity approach, the feedback measured color energies 34, 44, 54 are summed together by an adder 74 to generate a total measured energy $E_{tot}$ 76 that is input to a current adjuster 78 that adjusts the electrical current level 80 of the constant current power source 12 to achieve or approximate the condition $E_{set}=E_{tot}$. The current adjuster 78 can, for example, employ a digital proportional-integral-derivative (PID) control algorithm to adjust the electrical current level 80.

The illustrated embodiments include three color channels, namely R, G, B. However, more or fewer channels can be employed. For n=1, . . . , N channels where N is a positive integer and N>1, the time interval T is divided into N time intervals $f_1 \times T, \ldots, f_N \times T$ under the condition $f_1 + \ldots + f_N = 1$ where the fractions $f_1, \ldots, f_N$ are all positive values in the interval [0,1], and the switch 14 is a one-to-N switch.

In the case in which one of the channels is to be off entirely, that is, $f_n=0$, this can be achieved either by having the switch 14 bypass that color channel entirely, or by setting $f_n=\delta$ where $\delta$ is a value sufficiently small that the color corresponding to $f_n=\delta$ is not visually perceived.

The term "color" as used herein is to be broadly construed as any visually perceptible color. The term "color" is to be construed as including white, and is not to be construed as limited to primary colors. The term "color" may refer, for example, to an LED that outputs two or more distinct spectral peaks (for example, an LED package including red and yellow LEDs to achieve an orange-like color having distinct red and yellow spectral peaks). The term "color" may refer, for example, to an LED that outputs a broad spectrum of light, such as an LED package including a broadband phosphor that is excited by electroluminescence from a semiconductor chip. An "adjustable color light source" as used herein is to be broadly construed as any light source that can selectively output light of different spectra. An adjustable color light source is not limited to a light source providing full color selection. For example, in some embodiments an adjustable color light source may provide only white light, but the white light is adjustable in terms of color temperature, color rendering characteristics, or so forth.

Figure 6:
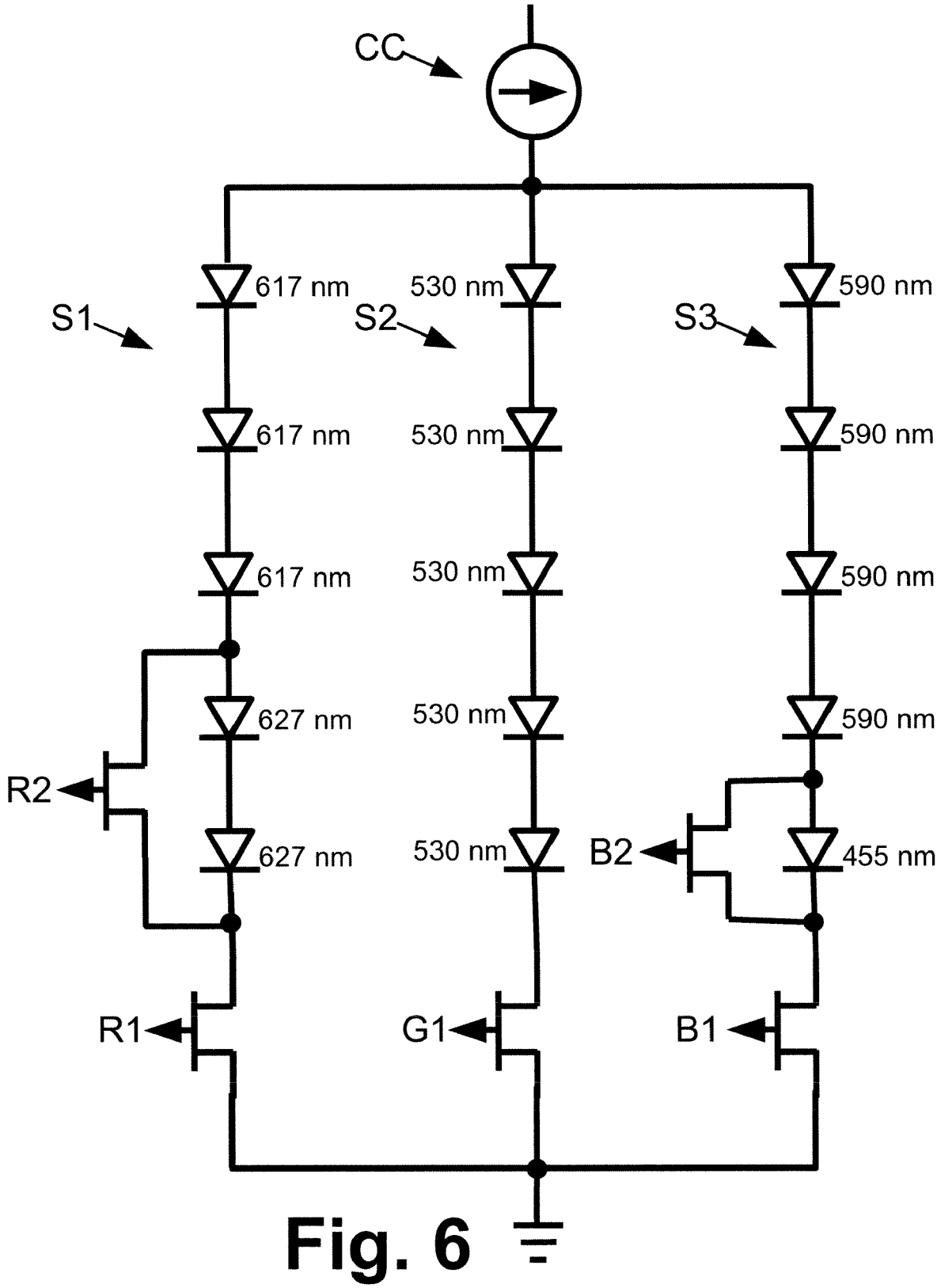
FIG. 6 diagrammatically illustrates an electrical circuit of another adjustable color illumination system.
Figure 7:
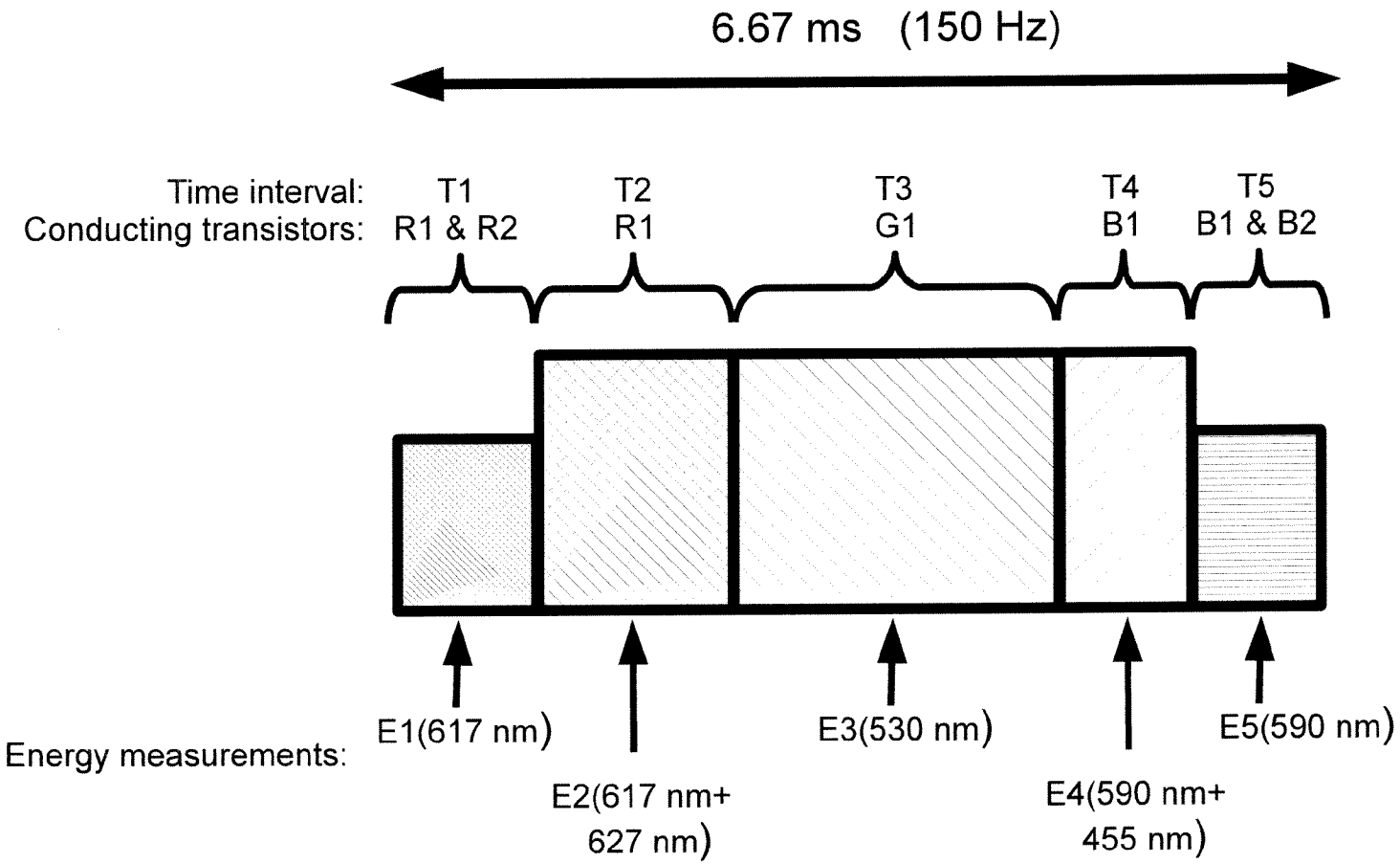
FIG. 7 diagrammatically illustrates a timing diagram for operation of the adjustable color illumination system of FIG. 6.
Figure 8:
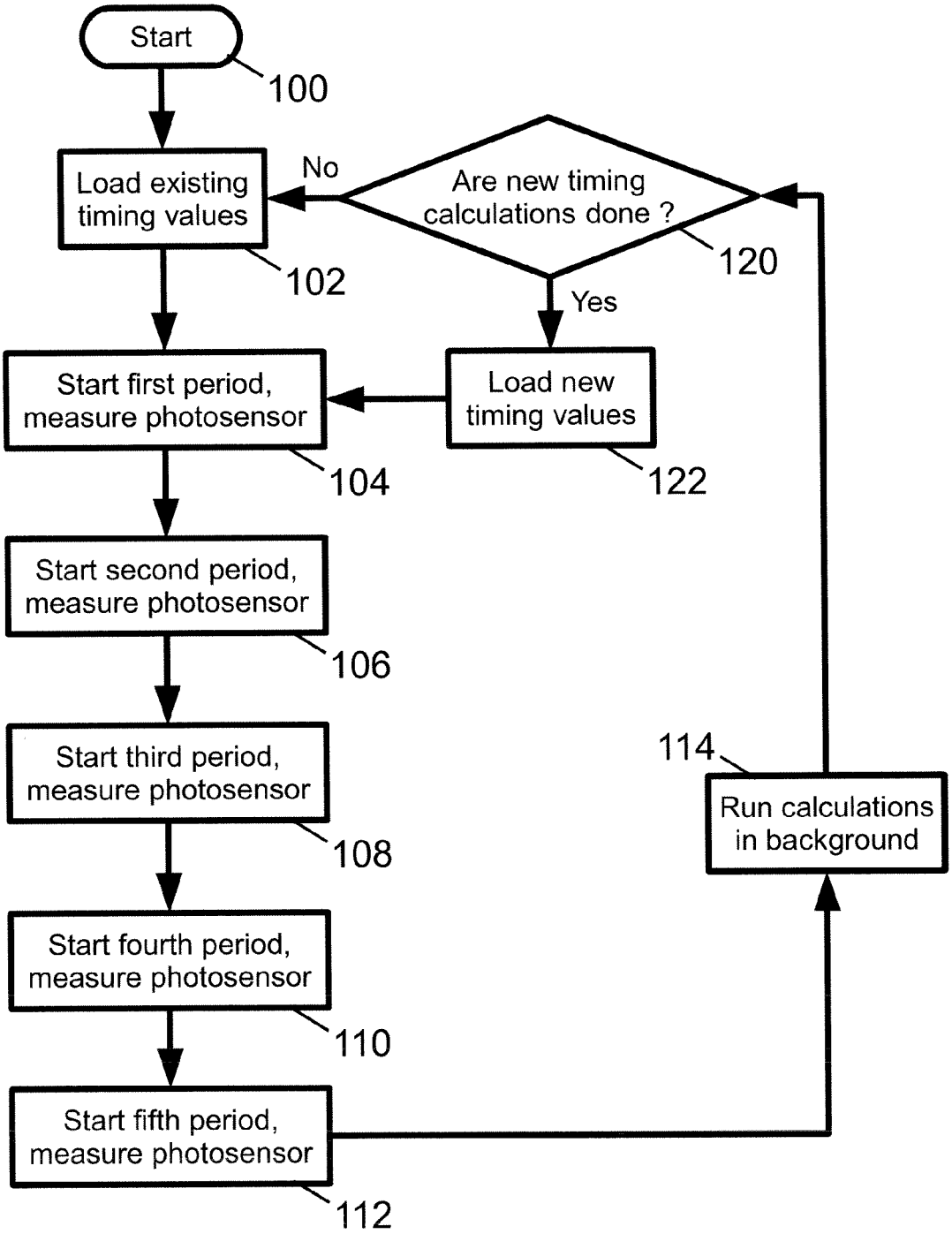
FIG. 8 diagrammatically illustrates a flow chart for operation of the adjustable color illumination system of FIG. 6.

With reference to FIGS. 6-8, another illustrative embodiment is shown as an example. FIG. 6 shows an adjustable color light source in the form of a set of three series-connected strings S1, S2, S3 of five LEDs each. The first string S1 includes three LEDs emitting at a peak wavelength of about 617 nm, corresponding to a shallow red, and two additional LEDs emitting at a peak wavelength of about 627 nm, corresponding to a deeper red. The second string S2 includes five LEDs emitting at 530 nm, corresponding to green. The third string S3 includes four LEDs emitting at a peak wavelength of about 590 nm, corresponding to amber, and one additional LED emitting at a peak wavelength of about 455 nm, corresponding to blue. Drive and control circuitry includes a constant current source CC and three transistors with inputs R1, G1, B1 arranged to block or allow current flow through the first, second, and third LED strings S1, S2, S3, respectively. Additionally, a transistor with input R2 enables the two deeper red (627 nm) LEDs to be selectively shunted, while a transistor with input B2 enables the blue (455 nm) LED to be selectively shunted. An operational state table for the adjustable color light source of FIG. 6 is given in Table 1. Note that the channel color listed for each channel is qualitative, and may be subjectively adjudged differently by different observers. The operational control is configured such that only one of the three LED strings S1, S2, S3 is driven at any given time; accordingly, the same current flows through the 617 nm LEDs of string S1 regardless of whether the R2 transistor is in the conducting or nonconducting state; and similarly the same current flows through the 590 nm LEDs of string S3 regardless of whether the B2 transistor is in the conducting or nonconducting state.

TABLE 1

| Fractional Time Period | Conducting transistors | Channel Illumination Peak Wavelength(s) | Channel Color (Qualitative) |
|---|---|---|---|
| T1 | R1 and R2 | 617 nm | Red |
| T2 | R1 | 617 nm and 627 nm | Deep red |
| T3 | G1 | 530 nm | Green |
| T4 | B1 | 590 nm and 455 nm | Blue-amber |
| T5 | B1 and B2 | 590 nm | Amber |

FIG. 7 plots the timing diagram for operation of the adjustable color illumination system of FIG. 6. The LED wavelengths or colors of the adjustable color illumination system of FIG. 6 are not selected to provide adjustable full-color illumination, but rather are selected to provide white light of varying quality, for example warm white light (biased toward the red) or cold white light (biased toward the blue). The adjustable color illumination system of FIG. 6 has five color channels as labeled in Table 1. In illustrative FIG. 7 the five transistors are operated to provide a one-to-five switch operating over a time interval T which in FIG. 7 is 1/150 sec (6.67 ms) in accordance with a selected time division of the time interval T to generate white light with selected quality or characteristics. The time interval T=1/150 sec is shorter than the flicker fusion threshold for a typical viewer. The time interval T is time-division multiplexed into five fractional time periods T1, T2, T3, T4, T5 where the five fractional time periods T1, T2, T3, T4, T5 are non-overlapping and sum to the time interval T, that is, T=T1+T2+T3+T4+T5. In the embodiment of FIG. 7, the color energy measurement for each color channel is acquired at an intermediate time substantially centered within each fractional time period, as indicated in FIG. 7 by the notations "E( . . . nm)" indicating the operating wavelengths at each color energy measurement.

With reference to FIG. 8, a control process suitably implemented by the control circuitry including the five transistors shown in FIG. 6 is illustrated. At a starting time 100 existing time values for the fractional time periods T1, T2, T3, T4, T5 are loaded 102 into a controller. This is followed by successive operations 104, 106, 108, 110, 112 initiate the five fractional time periods T1, T2, T3, T4, T5 in succession and perform energy measurements using a single photosensor. A calculation block 114 uses the measurements to compute updated values for the fractional time periods T1, T2, T3, T4, T5. For example, the relationship $[E1 \cdot T1]/[E2 \cdot T2]=C_{12}$ where $C_{12}$ is a constant reflecting the desired red/deep red color ratio is suitably used to constrain the fractional time periods T1 and T2; the relationship $[E2 \cdot T2]/[E3 \cdot T3]=C_{23}$ where $C_{23}$ is a constant reflecting the desired deep red/green color ratio is suitably used to constrain the fractional time periods T2 and T3; the relationship $[E3 \cdot T3]/[E4 \cdot T4]=C_{34}$ where $C_{34}$ is a constant reflecting the desired green/blue-amber color ratio is suitably used to constrain the fractional time periods T3 and T4; and the relationship $[E4 \cdot T4]/[E5 \cdot T5]=C_{45}$ where $C_{45}$ is a constant reflecting the desired blue-amber/amber color ratio is suitably used to constrain the fractional time periods T4 and T5. The calculation block 114 suitably simultaneously solves these four equations along with the constraint T=T1+T2+T3+T4+T5 to obtain the updated values for the fractional time periods T1, T2, T3, T4, T5. In some embodiments, the calculation block 114 operates in the background in an asynchronous fashion respective to the cycling of the light source at the time interval T. To accommodate such asynchronous operation, a decision block 120 monitors the calculation block 114 and continues to load existing timing values 102 until the updated or new timing values are output by the calculation block 114, at which time the new timing values are loaded 122.

It will be appreciated from the example of FIGS. 6-8 that the time-division multiplexing does not necessarily require that the LEDs be allocated in an exclusive manner between the fractional time periods. In the embodiment of FIGS. 6-8, for example, the amber LEDs emitting at 590 nm are operational during both the fourth fractional time period T4 and the fifth fractional time period T5. The embodiment of FIGS. 6-8 also illustrates that the color channels can correspond to different shades (e.g., shallow red versus deeper red), and that a given color channel may emit light of two or more distinct peaks at different colors (for example, during the fractional time period T4 both amber light peaked at 590 nm and blue light peaked at 455 nm are emitted).

The preferred embodiments have been illustrated and described. Obviously, modifications and alterations will occur to others upon reading and understanding the preceding detailed description. It is intended that the invention be construed as including all such modifications and alterations insofar as they come within the scope of the appended claims or the equivalents thereof.

The invention claimed is:

1. An adjustable color light source comprising:

a light source having different channels for generating illumination of different channel colors corresponding to the different channels; and an electrical power supply selectively energizing the channels using time division multiplexing to generate illumination of a selected time-averaged color, the electrical power supply including (i) a power source generating a substantially constant rms drive current on a timescale longer than a period T of the time division multiplexing and (ii) circuitry that time division multiplexes the substantially constant rms drive current into selected ones of the channels.

2. The adjustable color light source as set forth in claim 1, wherein the circuitry drives precisely one of the channels with the substantially constant rms drive current at any given time during operation of the adjustable color light source.

3. The adjustable color light source as set forth in claim 2, further comprising:

a current controller configured to communicate with the power source to adjust a current level of the substantially constant rms drive current.

4. The adjustable color light source as set forth in claim 1, wherein the substantially constant rms drive current is a substantially constant d.c. drive current.

5. The adjustable color light source as set forth in claim 1, further comprising:

a photosensor arranged to measure light from the light source, the photosensor being capable of measuring any of the different channel colors corresponding to the different channels of the light source.

6. The adjustable color light source as set forth in claim 5, wherein the color controller is configured to adjust the time division based on feedback provided by the photosensor compared with a setpoint color.

7. An adjustable color light source comprising:

a light source having different channels for generating illumination of different channel colors corresponding to the different channels;

an electrical power supply selectively energizing the channels using time division multiplexing to generate illumination of a selected time-averaged color;

a photosensor having a spectral response effective to measure any of the channel colors of the light source; and an optical meter configured to estimate at least ratios of optical energy output by the different channels during the selective energizing based on optical power measured by the photosensor correlated with the time division multiplexing.

8. An adjustable color source comprising:

a light source having different channels for generating illumination of different channel colors corresponding to the different channels, the light source including solid state lighting devices grouped into N channels wherein the solid state lighting devices of each channel are electrically energized together when the channel is selectively energized; and an electrical power supply selectively energizing the channels using time division multiplexing to generate illumination of a selected time-averaged color, the electrical power supply including (i) switching circuitry arranged to energize a selected one of the N channels and (ii) a color controller causing the switching circuitry to operate over a time interval T in accordance with a selected time division of the time interval T to generate illumination of the selected time-averaged color, wherein the time interval T is shorter than a flicker fusion threshold.

9. The adjustable color light source as set forth in claim 8, wherein the solid state lighting devices include LEDs.

10. The adjustable color light source as set forth in claim 8, wherein the LEDs include at least one shared LED that is a member of an overlapping two or more of the N channels such that the at least one shared LED is energized when any one of the overlapping two or more of the N channels is selectively energized.

11. The adjustable color light source as set forth in claim 8, further comprising:

a broadband photosensor having a detection bandwidth encompassing the channel colors generated by the N channels; and an optical meter receiving a detection signal from the broadband photosensor during each time division and computing a measured optical energy for each time division based at least on the received detection signals;

wherein the color controller is configured to adjust the time division of the time interval T based on the measured optical energies and a setpoint color.

12. An adjustable color light generation method comprising:

generating a drive electrical current;

energizing a selected channel of a multi-channel light source using the generated drive electrical current;

cycling the energizing amongst channels of the multi-channel light source fast enough to substantially suppress visually perceptible flicker due to the cycling; and controlling a time division of the cycling to generate a selected time-averaged color.

13. The adjustable color light generation method as set forth in claim 12, wherein the generated drive electrical current has a substantially constant rms current value on a time scale of the cycling.

14. The adjustable color light generation method as set forth in claim 13, wherein the generated drive electrical current has a substantially constant d.c. current value on a time scale of the cycling.

15. The adjustable color light generation method as set forth in claim 13, wherein the generating comprises adjusting the substantially constant rms current value on a time scale substantially larger than the cycling.

16. The adjustable color light generation method as set forth in claim 12, wherein the cycling energizes exactly one of the channels of the multi-channel light source at any point in the cycling.

17. An adjustable color light source comprising:

a plurality of illumination channels for generating illumination of different channel colors; and an electrical power supply cycling an electrical drive current amongst the plurality of illumination channels to generate illumination of a selected time-averaged color, the cycling being non-overlapping in that exactly one illumination channel is driven by the electrical drive current at any point in the cycling.

18. The adjustable color light source as set forth in claim 17, wherein the electrical drive current is substantially constant on a time scale of the cycling.

19. The adjustable color light source as set forth in claim 17, further comprising:

a photosensor arranged to measure electrical power of any channel of the plurality of illumination channels; and a color controller configured to adjust the cycling based on a signal received from the photosensor and correlated with the cycling.

* * * * *